United States Patent [19]

Paulve

[11] 4,390,134

[45] Jun. 28, 1983

[54] UNDERGROWTH CRUSHER

[76] Inventor: Marcel L. A. Paulve, Moulin des Serres, 83490 Le Muy, France

[21] Appl. No.: 180,909

[22] Filed: Aug. 25, 1980

[30] Foreign Application Priority Data

Aug. 30, 1979 [FR] France ..... 79 21797

[51] Int. Cl.[3] ..... B02C 18/06

[52] U.S. Cl. ..... 241/101.2; 241/294

[58] Field of Search ..... 74/63; 241/101.2, 222, 241/221, 223, 292.1, 294

[56] References Cited

U.S. PATENT DOCUMENTS

| | | | |
|---|---|---|---|
| 3,059,384 | 10/1962 | McClellan | 241/221 |
| 3,378,053 | 4/1968 | Potzsch | 241/221 |
| 3,430,873 | 3/1969 | Wahl | 241/55 |
| 3,995,783 | 12/1976 | Bertrand et al. | 241/222 |
| 4,019,396 | 4/1977 | Frechette | 74/63 |

FOREIGN PATENT DOCUMENTS

| | | | |
|---|---|---|---|
| 2353371 | 7/1974 | Fed. Rep. of Germany . | |
| 2431349 | 1/1976 | Fed. Rep. of Germany . | |
| 2722280 | 11/1978 | Fed. Rep. of Germany | 241/ 294 |
| 119175 | 9/1918 | United Kingdom . | |

*Primary Examiner*—John McQuade

*Attorney, Agent, or Firm*—Steinberg & Raskin

[57] ABSTRACT

A crusher 1 used particularly for clearing woods or forest of undergrowth, is provided with a drum 2 and cutting devices 6 mounted into slots 5 of the drum. Said cutting devices comprise a counter-blade 8, a blade 7, tightening device for holding said cutting device in slot 5 and adjusting means for adjusting the height of the blade 7. Said adjusting means are preadjusted before the mounting of the blade 7.

6 Claims, 5 Drawing Figures

UNDERGROWTH CRUSHER

The present invention relates generally and has essentially for its subject matter a crushing device or crusher intended more particularly to be used for clearing and cleaning woods or forests of undergrowth.

Use is generally made, in such crushers, of the known principle of wood planing machines, i.e. of blades mounted tangentially to a rotating cylinder. The fixing of the plates on the cylinder is one of the problems to be solved. Some devices provide for the fixing of the blades by means of longitudinal grooves. This method, however, is very expensive for it requires not only the cutting of the grooves on the rotating cylinder but also an accurate reproduction of such grooves on the blades themselves. In other devices, use is made of stop-screws placed at the bottom of the blade-support housings provided in the rotating cylinder. This, however, results in that the removal of the blades either for sharpening purposes or simply for replacement requires careful and time-consuming work which is very difficult for a forest worker to perform.

It should also be noted that the cylinder of crushers such as, in particular forest or wood undergrowth crushers rotating at a much higher speed than the power take-off of the driving devices such as the tractors pulling such crushers require the use of a speed-increasing gear. Such a speed-increasing gear is generally constituted by a simple V-belt drive. This solution, however, suffers from the drawback that the rotating cylinder (the heavier part of the crusher) is not coaxial with the lifting device of the agricultural tractors on which it may have to be installed. In the case of small tractors, the eccentricity due to this type of transmission results in a considerable unbalance.

The invention is intended to remedy such drawbacks by providing a crusher which is characterized by a cutting device constituted by a blade, a counter-blade against which the said blade bears by one of its faces, and a tightening device carried by the counter-blade for pressing the other face of the blade against one of the longitudinal lateral walls of the slot forming a housing for the blade and provided at the periphery of the rotating cylinder, the said tightening device being pressed against the other longitudinal lateral wall of the said slot.

According to another characterizing feature of the invention, the tightening device is constituted by at least one screw partially screwed into a threaded bore of the counter-blade and whose free end located outside the counter-blade tightly abuts against the adjacent longitudinal lateral wall of the slot forming said housing.

According to another characterizing feature of the invention, there is provided a device for adjusting the height of the blade, which device is carried by the counter-blade and is constituted by at least two adjustable screws on the ends of which abuts the end surface of the blade opposite to its cutting end.

According to another characterizing feature of the invention, the adjustment of the screws for adjusting the height of the blade is performed before its mounting in the associate housing of the rotating cylinder of the crusher.

According to another characterizing feature of the invention, the axis of the rotating drum is aligned with the power take-off of a driving device such as a tractor pulling the crusher.

Other characterizing features, advantages and details will appear more clearly from the following explanatory description made with reference to the appended drawings given solely by way of the example and wherein.

Figure 1:
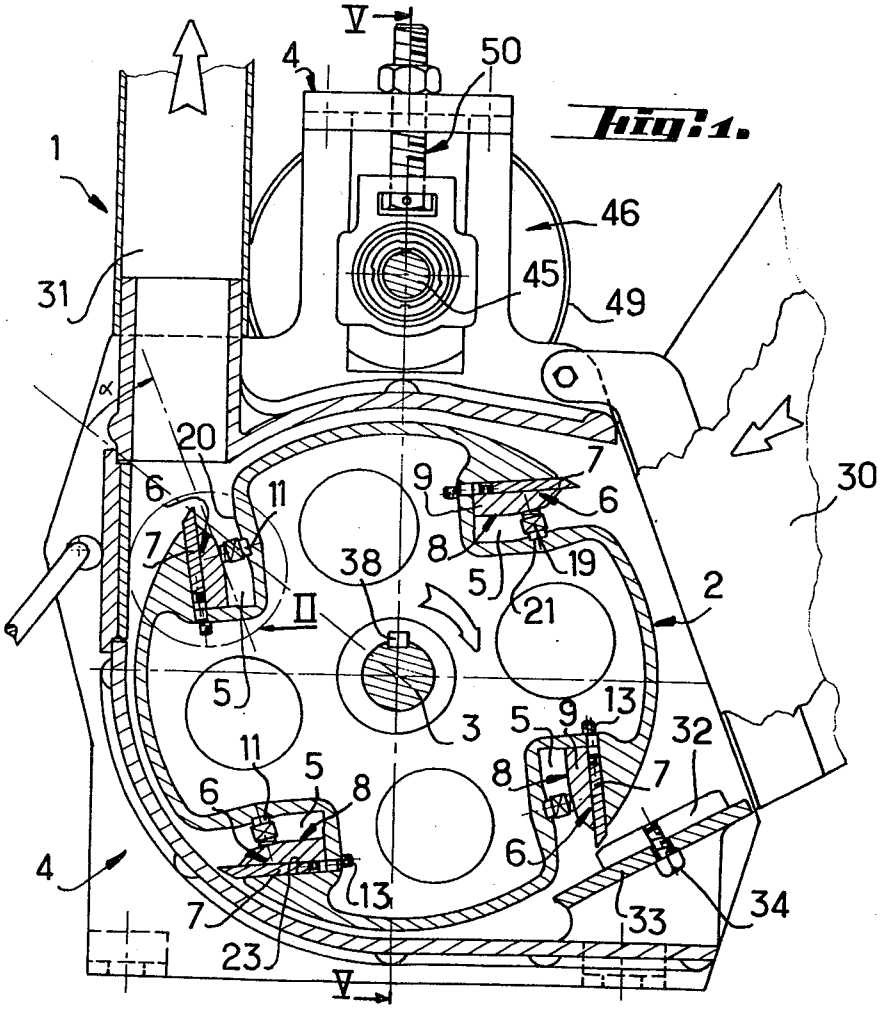
FIG. 1 is a sectional view in a plane perpendicular to the axis of the rotating cylinder of the crusher according to the invention.

Referring to the Figures and particularly to FIG. 1, the crusher 1 according to the invention comprises a rotating cylinder or drum 2 rotatably mounted on a shaft 3 itself supported in rotation by the frame or casing 4 of the crusher 1.

The drum 2 is provided on its periphery with parallel longitudinal slots 5, e.g., uniformly spaced from one another and four in number in the example illustrated. Each slot forms a housing for a cutting device 6 to be described later.

Each slot 5 is shifted by an angle $\alpha$, in the direction of rotation of the drum 2, with respect to a slot which would be located radially with respect to the drum 2. The said angle is in the range of between about 30° and 45°.

Figure 2:
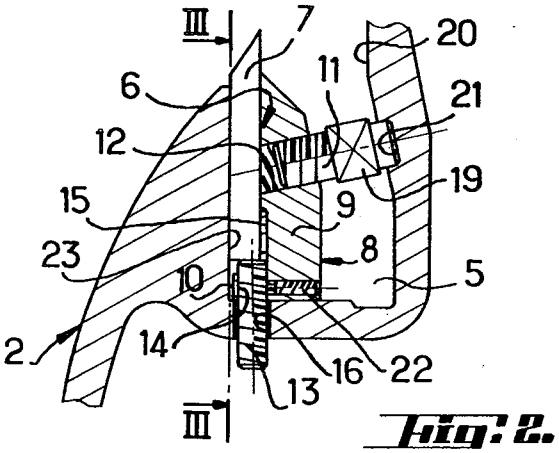
FIG. 2 is an enlarged detailed view of the portion indicated by arrow II in FIG. 1 to illustrate a cutting device of the crusher and its mounting.
Figure 4:
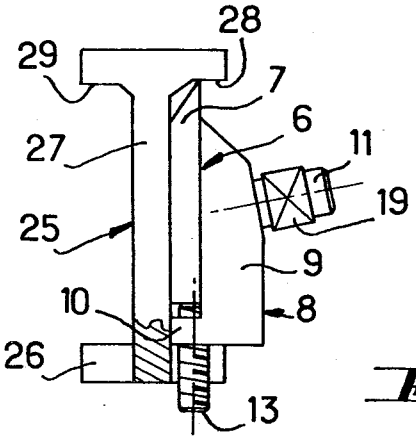
FIG. 4 is an elevational sectional view of an adjusting template allowing the height of the crusher blades to be adjusted.
Figure 3:
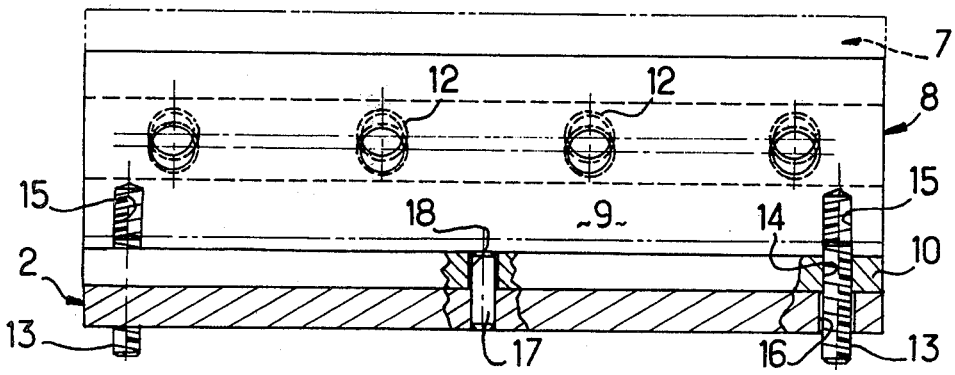
FIG. 3 is a sectional view upon the line III—III of FIG. 2 with parts broken away.

In each slot 5 is mounted a removable cutting device 6 comprising a blade 7 and a counter-blade 8 which will be described in more detail with reference to FIGS. 2 to 4.

A blade 7 is in the form of a rectangular plate bevelled at one of its longitudinal ends to form a cutting edge.

A counter-blade 8 is in the form of a substantially parallelepipedic block 9 extending over substantially the same length as the blade 7. The said counter-blade is provided along one of its longitudinal edges with a flange 10 at 90° extending along the whole length of the block 9 and the width of which corresponds substantially to that of the blade 7.

Each counter-blade 8 carries on the one hand a device for tightening the blade 7 and a device for adjusting the height of the blade 7. The said tightening device is constituted by at least two screws 11 partly screwed into two threaded orifices 12 provided in the block 9 of the counter-blade 8. Each device for adjusting the height of the blade 7 is constituted by at least two screws 13 mounted respectively in two threaded orifices 14 of the flange 10 of the counter-blade 8. It is important to note that the screws 13 protrude from either side of the flange 10 and are also screwed into two threaded blind semi-bores 15 cut in the adjacent longitudinal face of the block 9 of the counter-blade 8 and axially aligned with the threaded orifices 14.

The mounting of a cutting device 6 in an associated slot 5 of the drum 2 is performed as follows.

The first step consists in introducing the counter-blade 8 into the slot 5 so that the block or body 9 of the counter-blade 8 is placed parallel with the external longitudinal lateral wall 23 of the associated slot 5 by bearing on the bottom of the slot 5 by its end surface extended by the flange 10 which itself comes into contact with the lateral wall 23. There is thus defined between the adjacent walls of the slot 5 and the body 9 of the counter-blade 8 a space into which a blade 7 is introduced so as to abut by its end surface opposite to its cutting edge against the adjacent ends of the adjusting screws 13 protruding beyond the flange 10 of the counter-blade 8.

It should be noted that in the bottom of the slot 5 are provided two orifices 16 which receive the portions of the screws 13 which protrude beyond the flange 10 of the counter-blade 8 and which do not cooperate directly with the blade 7. In order to facilitate this process, a guiding pin 17 is engaged into the bottom of the slot 5 and is received freely by its free end in an orifice 18 provided in the flange 10 of the counter-blade 8 (FIG. 3), the said orifice 18 being for example provided between two orifices 14 of the flange 10 of the counter-blade 8.

After the blade is thus positioned, it has to be fixed or more exactly pressed against the external longitudinal lateral wall 23 of the slot 5. It is sufficient, to this end, to manipulate the fixing screws 11. To facilitate this fixing step, each screw 11 is for example integral with a screw-head portion 19 provided towards the free end of the screw 11 which is not introduced into the associated orifice 12 of the counter-blade 8. The screw-head portion 19 allows the screw to be screwed in a direction tending to withdraw the screw 11 from its orifice 12 so as to move the free end of the screw 11 into pressed contact with the other longitudinal lateral surface 20 or an internal lateral surface of the slot 5. The internal lateral surface 20 is advantageously provided with a longitudinal slot 21 intended to receive the adjacent end of the fixing screws 11 so as to ensure an improved tightening. The reaction opposed by the fixing screw 11 ensures the tightening of the counter-blade 8 and therefore the blade 7 against the external longitudinal lateral surface 23 of the slot 5.

It should also be noted that the screws 13 for adjusting the height of the blade 7 are advantageously locked in position through the medium of for example pressing or set screws 22 mounted perpendicularly to the adjusting screws 13 so as to tightly abut against the latter by one of the ends. Each pressing screw 22 is supported by the counter-blade 8 by being for example screwed into a threaded bore of the counter-blade 8 and opening at one end into the corresponding threaded orifice 14 of the flange 10 in which the associated adjusting screw 13 is screwed.

It is important to note that when each counter-blade 8 is mounted in its associated slot 5, the adjusting screws 13 are already adjusted so that, after the blade 7 is mounted, the cutting edge of the plate is perfectly positioned with respect to the drum. The previous adjustment of the screws 13 is performed through the medium of a template 25 or the like represented in FIG. 4.

The adjusting template 25 comprises a base 26 surmounted by a T-shaped structure 27. Before being mounted, each counter-blade 8 and its associated blade 7 are placed on the template 25 between its base 26 and one of the lateral arms of the T-shaped structure 27. Thereafter, the adjusting screws 13 are adjusted so that the cutting edge of the blade 7 comes into contact with the lower surface 28 or 29 of the lateral arms of the T-shaped structure 27. It should be noted that the lower surfaces 28 and 29 of the two arms of the T-shaped structure 27 are not at the same height with respect to the base 27, thus allowing two different adjustments of the blades 7. After this adjustment is completed, the counter-blade 8 supporting the adjusted adjusting screws 13 and the tightening screws 11 and the blade are mounted in the associated slot 5 of the drum 2.

Referring again to FIG. 1, the space defined between the drum 2 and the frame 4 of the crusher 1 communicates, on the one hand with an inlet conduit 30 for introducing the elements to be crushed and a discharge conduit 31 for ejecting the crushed products which are thereafter conveyed for example to a motor or trailer truck.

The crusher 1 according to the invention also comprises a member 32 serving as a cutting support. The member 32 is located in proximity to the inlet conduit 30 and is borne by a support 33 integral with or secured to the frame or casing 4 of the crusher. It should be noted that the member 32 in the form of a plate is maintained on its support 33 by at least one screw 34 which is threaded in a bore formed in member 32 which is not located on the axis of symmetry or centerline of the member 32. Indeed, according to the two adjustment positions offered by the template 25 and the corresponding different heights of the blades adjusted thereby, the member 32 may be mounted in either one of two positions by simply reversing the member 32 by 180° with respect to its support 33 to adjust the clearance between the member 32 and blade 7 during operation. This arrangement prevents the cutting edge of the blade 7 from coming into contact with the supporting member 32. Thus, when the elements to be crushed are introduced through the inlet conduit 30, they fall between the support plate 32 and the drum 2 which rotates and crushes, the said elements in the region of the support plate 32.

Figure 5:
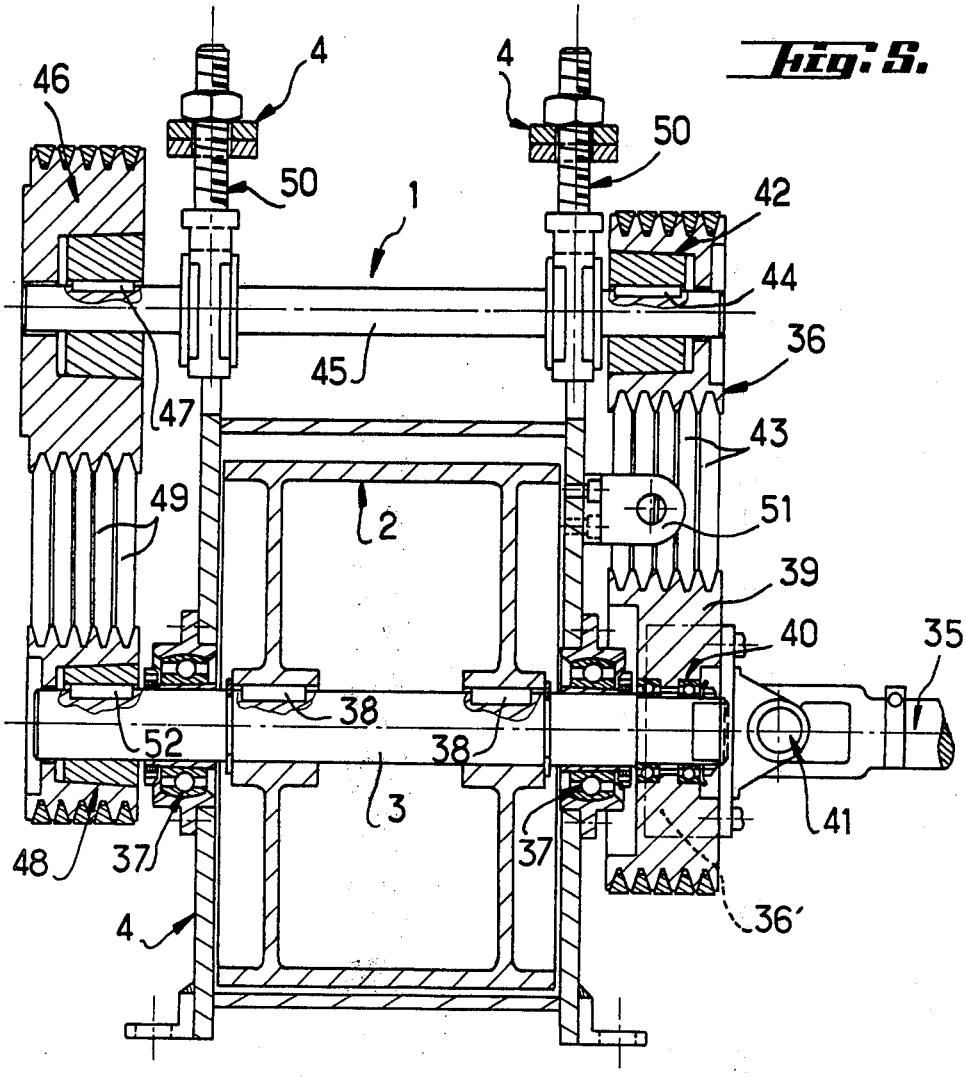
FIG. 5 is a sectional view upon the line V—V of FIG. 1 illustrating the crusher rotating cylinder driving system.

Referring to FIG. 5, there will now be described the device for driving the drum 2 in rotation.

The power take-off, such as a driving shaft 35 driven in rotation by a driving member (not shown), drives the drum 2 in rotation through the medium of a transmission 36 allowing the drum 2 to rotate faster than the shaft 35.

Before describing the transmission 36, it should be noted that the shaft 3 for rotating the drum protrudes from both sides of the latter.

A shaft 3 is supported in rotation through the medium of bearings 37, e.g., roller bearings, supported by the frame 4 of the crusher. The drum 2 is jointly rotatable with the shaft 3 by means of keys 38.

The transmission 36 is constituted by a first grooved pulley 39 idly mounted, through the medium of a roller bearing 40, on the shaft 3 in proximity to its end adjacent to the driving shaft 35. The pulley 39 is jointly rotatable with the shaft 35 through the medium of a Cardan joint 41. The pulley 39 drives in rotation a second grooved pulley 42 of smaller diameter through the medium of transmission belts 43. The pulley 42 is jointly rotatable, through the medium of a key 44, with a shaft 45 parallel with the shaft 3 and supported in rotation by the casing 4 of the crusher 1. The shaft 45, towards its other end, supports a third grooved pulley 46 of substantially the same diameter as the grooved pulley 39. The pulley 46 is jointly rotatable with the shaft 45 through the medium of a key 47. This third pulley 46 drives in rotation a fourth grooved pulley 48 through the medium of belts 49. The pulley 48 is mounted on the shaft 3 towards its end opposite to the first pulley 39 and is jointly rotatable therewith by means of a key 52. The pulley 48 is substantially equal in diameter to the second pulley 42.

The transmission 36 mounted between the driving shaft 35 and the drum 2 is therefore constituted, in the form of embodiment described, by a double belt-drive including a countershaft, which allows the shaft 35 and the drum 2 to rotate in the same direction but at different speeds while being substantially axially aligned, thus allowing any unbalance between the tractor member (not shown) and the crusher 1 to be avoided.

The required tension of the belts 43 (between the first pulley 39 and the second pulley 42) and of the belts 49 (between the third pulley 46 and the fourth pulley 48 driving the drum 2) is obtained by means of two tensioning devices 50 which allow the distance to be varied between the shaft 3 supporting the drum 2 and the shaft 45 supporting the intermediate pulleys 42 and 46.

According to a second form of embodiment of the transmission 36 between the driving shaft 35 and the shaft 3 supporting the drum 2, the double belt-drive may be replaced by an epicyclic train or planetary gearing 36' mounted between the Cardan joint 41 and the adjacent end of the shaft 3 substantially axially aligned with the shaft 35.

On the crusher casing 4 are provided several fixing lugs 51 which allow the crusher 1 to be fixed for example to an automatic tractor-lifting device.

The crusher according to the invention is therefore equipped with cutting devices 6 that are easy to mount in the drum housings 5 with the blades 7 already adjusted in height by means of the screws 13 carried by the counter-blades 8. When it is desired to sharpen the blade 7, the length of which may have varied as a result of operating troubles (chipping or the like) it is sufficient to remove the blade 7 concerned and its associated counter-blade 8 and to adjust the blade anew through the medium of the adjusting template 25. Under such conditions, the expenditure of time for mounting and removing the blades 7 and for the adjusting steps are considerably reduced and the handling operations facilitated.

What is claimed is:

1. A crusher comprising a drum having a peripheral surface and mounted for rotation on a shaft supported by a crusher frame, said drum being provided on its periphery with several longitudinal slots substantially uniformly spaced from each other, said slots each having opposed lateral surfaces and forming a housing for a respective cutting device; an inlet conduit for introducing objects to be crushed; an outlet conduit for discharging the crushed objects; a drive system for rotating said drum; several cutting devices housed within respective ones of said slots, each cutting device being constituted by a blade/counter-blade assembly including a blade having a pair of opposed faces and a bevelled side forming a cutting surface and an associated counter-blade against which one of said opposed faces of said blade bears, said counter-blade being in the form of a substantially parallelepipedic block having a flange on the rear side thereof; tightening means for urging each said blade/counter-blade assembly against one of said lateral surfaces of the respective slot in which it is housed; and a respective device cooperating with each of said blade/counter-blade assemblies for adjusting the height of each blade with respect to the counter-blade associated with it and the location of said blade/counter-blade assembly in its respective slot with respect to the peripheral surface of said drum, each of said height adjusting devices being entirely supported by said counter-blade, each of said height adjusting devices being constituted by at least two screws which extend through respective bores formed in said flange of the counter-blade so that one end of each screw abuts against the end surface of the associated blade which is opposite from its cutting surface, and wherein said tightening means are constituted by at least one screw partially threaded at one end into a threaded bore of the counter-blade and having a free other end which is pressed against the other lateral surface of said slot to urge a face of the associated blade against said one of said lateral surfaces of said slot.

2. The combination of claim 1, wherein a groove is formed in said other lateral surface of the slot and wherein the free end of said tightening screw is pressed against the bottom of the groove.

3. The combination according to claim 1, wherein the position of said screws of each of said height adjusting devices in said respective bores formed in said counter-blade flange are preadjusted in a template means which simulates said drum slots in which the blade is to be housed to provide a pre-adjustment of the height of the blade with respect to the associated counter-blade before the blade/counter-blade assembly is housed in said slot.

4. The combination according to claim 1, wherein the screws constituting each of said height adjusting devices are mounted in respective threaded orifices formed in the flange of the counter-blade supporting the same and protrude from each side of the flange, and wherein said slot in which the counter-blade is housed has a bottom in which orifices are formed which receive the portions of the screws which protrude beyond the side of the flange which is remote from said blade.

5. The combination of claim 1, wherein said drive system for rotating said drum comprises a drive shaft substantially axially aligned with said drum shaft, a first pair of pulleys mounted on said drum shaft, one of said first pair of pulleys being mounted for free rotation on said drum shaft and connected to said drive shaft and the other of said first pair of pulleys being fixed for rotation with said drum shaft, a counter-shaft rotatably mounted on said crusher frame, a second pair of pulleys fixed on said counter-shaft for rotation therewith, and a pair of flexible members interconnecting respective ones of said first and second pair of pulleys to each other and wherein said pulleys are sized so as to impart to said drum a higher rotating speed than that of said drive shaft.

6. A crusher comprising a drum having a peripheral surface and mounted for rotation on a shaft supported by a crusher frame, said drum being provided on its periphery with several longitudinal slots substantially uniformly spaced from each other, said slots each having opposed lateral surfaces and forming a housing for a respective cutting device; an inlet conduit for introducing objects to be crushed; an outlet conduit for discharging the crushed objects; a drive system for rotating said drum; several cutting devices housed within respective ones of said slots, each cutting device being constituted by a blade/counter-blade assembly including a blade having a pair of opposed faces and a bevelled side forming a cutting surface and an associated counter-blade against which one of said opposed faces of said blade bears, said counter-blade being in the form of a substantially parallelepipedic block having a flange on the rear side thereof; tightening means for urging each said blade/counter-blade assembly against one of said lateral surfaces of the respective slot in which it is housed; and wherein said crusher further comprises a respective device cooperating with each of said blade/-counter-blade assemblies for adjusting the height of each blade with respect to the counter-blade associated with it and the location of said blade/counter-blade assembly in its respective slot with respect to the peripheral surface of said drum, said height adjusting devices being entirely supported by said counter-blade and being constituted by at least two screws which extend through respective bores formed in said flange of the counter-blade so that one end of each screw abuts against the end surface of the associated blade which is opposite from its cutting surface, and wherein said screws constituting each said height adjusting device are mounted in respective threaded orifices formed in the flange of the counter-blade supporting the same and protrude from each side of the flange, and wherein said slot in which the counter-blade is housed has a bottom in which orifices are formed which receive the portions of the screws which protrude beyond the side of the flange which is remote from said blade.

* * * * *